United States Patent [19]

Yasutome et al.

[11] 4,020,386

[45] Apr. 26, 1977

[54] FLAT TYPE DISPLAY TUBE

[75] Inventors: Osamu Yasutome, Taishi; Mitsuo Takeda, Tokyo; Tagayasu Sawamura, Himeji; Norio Shinoda, Taishi, all of Japan

[73] Assignee: Tokyo Shibaura Electric Co., Ltd., Kawasaki, Japan

[22] Filed: Dec. 24, 1975

[21] Appl. No.: 644,036

[30] Foreign Application Priority Data

Dec. 25, 1974 Japan ..... 49-156715[U]

[52] U.S. Cl. ..... 313/496; 313/318; 313/513

[51] Int. Cl.[2] ..... H01J 1/62

[58] Field of Search ..... 313/210, 513, 517, 519, 313/220, 318, 496, 497; 315/169 TV

[56] References Cited

UNITED STATES PATENTS

| | | | |
|---|---|---|---|
| 3,323,241 | 6/1967 | Blair et al. | 315/169 TV |
| 3,868,535 | 2/1975 | Kupsky | 313/519 |
| 3,893,101 | 7/1975 | Glaser | 315/169 TV |

*Primary Examiner*—Rudolph V. Rolinec
*Assistant Examiner*—Lawrence J. Dahl
*Attorney, Agent, or Firm*—Oblon, Fisher, Spivak, McClelland & Maier

[57] ABSTRACT

A flat type display tube has an exhaust tube extending outward in a plane of the surface of the substrate and a plurality of current supply lead-in strips. The exhaust tube and lead-in strips extend in the same direction from a body of the display tube. The lead-in strip is bent partway in a position short of the exhaust tube and in a direction substantially vertical to the plane of the surface of the substrate.

10 Claims, 6 Drawing Figures

FLAT TYPE DISPLAY TUBE

BACKGROUND OF THE INVENTION

This invention relates to a flat type fluorescent display tube and in particular to a fluorescent display tube for use in a desk-top type electronic calculator.

Generally, a fluorescent display tube is driven at a low voltage of scores of volts and it is frequently used as a display for a desk-top type electronic calculator, since it has a sufficient brightness from the standpoint of visibility. A cylindrical type dispay tube has been conventionally used, but it is being recently replaced by a flattened box type multi-digit display tube in view of a small size requirement, as well as a flatness requirement, of the desk-top electronic calculator. A flat type display tube has been proposed in which lead-in conductors such as current supply lead-in strips and exhaust tube extend in the same direction from a body of the display tube. In such a type, the lead-in strips and exhaust tube are disposed close to each other, offering the following disadvantages. That is, no efficient sealing operation can be effected on the exhaust tube due to the close proximity of the lead-in strips. It is preferred that such a sealing operation be automated, but the neighboring lead-in strips provide a bar to such an automatic operation. Furthermore, the lead-in strips are tarnished, during the air evacuation of the tube, due to oxidation and a further treatment such as polishing etc. is required in removing the oxidation film from the lead-in strip. Since in this case the lead-in conductor is in close proximity to the exhaust tube, there is a danger that the exhaust tube will be broken when polishing the tarnished lead-in conductor. A soldering operation is effected in connecting the lead-in conductor to an associated external circuit. At this time there is also a danger that the exhaust tube will be broken due to a heat being transmitted during the soldering operation from the lead-in conductor to the exhaust tube. With these disadvantages in view a modified display tube is proposed at the expense of a small size requirement, in which an exhaust tube extends in one direction and lead-in strips extend in a direction opposite to that of the exhaust tube. However, there is a growing demand for a flat type desk-top calculator of small size and dimension. In view of a small size requirement the calculator is so unreasonably designed that the exhaust tube of the display tube is in direct contact with the casing of the calculator. In this case, a crack will be developed in the exhaust tube of the built-in display tube due to vibration etc. applied on the calculator from the outside. The crack in the exhaust tube breaks a vacuum in the display tube, failing to cause the display tube to be driven.

SUMMARY OF THE INVENTION

It is accordingly one object of this invention to provide a flat type display tube of small size and dimension.

Another object of this invention is to provide a flat type display tube which shows a good operability during the manufacture.

A further object of this invention is to provide a flat type display tube of suitable size and shape which is suitably adapted for use as a display section of a compact, flat type desk-top electronic calculator and very convenient to the design and manufacture of the calculator.

According to this invention, a box-like cover glass is hermetically sealed to a substrate in a manner to enclose one surface of the substrate and an exhaust tube is hermetically mounted at one end of the cover glass so as to communicate with the interior of the cover glass. The exhaust tube projects in a plane parallel to a substrate surface and has a free end sealed. A plurality of lead-in strips extend, through a joint between the cover glass and the substrate, in a direction parallel to the direction in which the exhaust tube extends. All the lead-in strips are bent partway in a direction substantially vertical to the substrate surface and in a position relatively remote from the free end of the exhaust tube. Since the lead-in strip extends in the same direction as that of the exhaust tube, a compact display tube can be obtained. Furthermore, since the lead-in conductor is bent partway in a position relatively remote from the sealed free end of the exhaust tube, the operability is improved during the manufacture of the display tube.

DETAILED DESCRIPTION OF THE INVENTION

Figure 1:
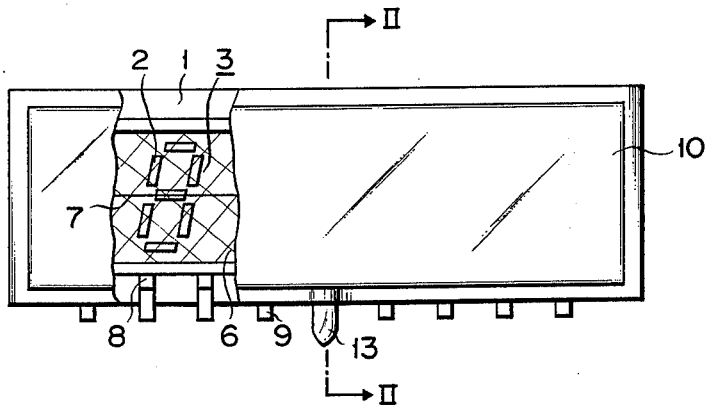
FIG. 1 is a plan view showing a flat type multi-digit display tube according to one embodiment of this invention with a cover glass partly broken away to show part of the interior of the display tube.
Figure 2:
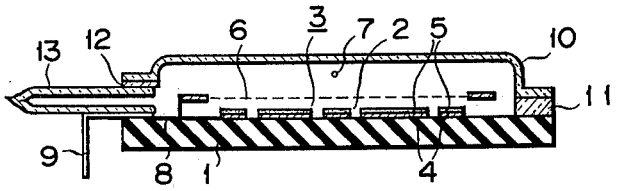
FIG. 2 is a cross-sectional side view as taken along line II—II in FIG. 1.

In FIG. 1 is shown a fluorescent light display section 3 consisting of a plurality of anode segments 2 arranged in a predetermined pattern on a substrate 1. A flat type display tube as generally shown in FIG. 1 is of a multi-digit type having a plurality of fluorescent light display sections 3. In FIG. 1 only one display section is shown merely by way of explanation. The display section 3 can display numerals, characters, marks etc. If, for example, any numeral is to be displayed, seven anode segments 2 are arranged in the form of a number "8". The anode segment is obtained by providing anodes 4 on the substrate 1 as shown in FIG. 2 and forming a phosphor layer 5 on the anode 4. A phosphor layer is formed by deposition, printing, electrodeposition etc. A mesh-like grid 6 is disposed above the display section with a predetermined space left therebetween. A wire-like cathode is disposed at an interval above the grid 6.

The anode 4, grid 6 and cathode 7 are each electrically connected to a corresponding electroconductive layer 8 formed on the substrate 1. Each electroconductive layer 8 is connected to a corresponding lead-in conductor, for example, a current supply lead-in strip 9 which extends outward beyond the substrate 1. The display section 3, grid 6, cathode 7 and electroconductive layer 8 are all housed within a box-like cover glass 10 which is transparent at least with respect to the display section 3. The cover glass is hermetically sealed at each end to the substrate through a frit glass 11. In this embodiment the lead-in strips 9 extend outward in a manner to be hermetically sandwiched between the cover glass 10 and the substrate 1. At the side wall of the box-like cover glass 10 is provided an opening 12 into which one end of an exhaust tube 13 is hermetically fitted. The exhaust tube 13 communicates at one end with the interior of the cover glass and is sealed at the other end beyond the cover glass 10. The exhaust tube 13 and lead-in strip 9 extend in the same direction from the cover glass 10 and in a parallel relation to the plane of the surface of the substrate 1. All the lead-in strips 9 are bent downward in a position short of the free end of the exhaust tube 13. It is preferred that the lead-in strip 9 in particular be bent in a position unobstructed during the sealing operation of the exhaust tube 13, for example, in a position remote from the sealed free end of the exhaust tube 13. The length of the lead-in strip as measured from the bent place of the lead-in strip is determined dependent upon where a display tube drive circuit (not shown) on a printed board is connected. It is preferred, however, that the bent length of the lead-in strip be long enough not to impart vibration etc. to the exhaust tube 13 during the polishing operation of the lead-in strip 9.

A modified display tube will now be explained below by reference to FIGS. 3 and 4, in which similar reference numerals are employed to designate parts or elements corresponding to those shown in FIGS. 1 and 2.

Figure 3:
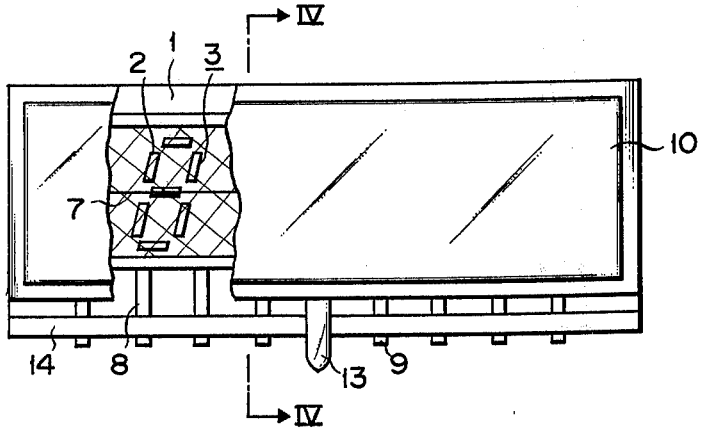
FIG. 3 is a plan view showing a flat type multi-digit display tube according to another embodiment of this invention with a cover glass broken away to show part of the interior of the display tube.
Figure 4:
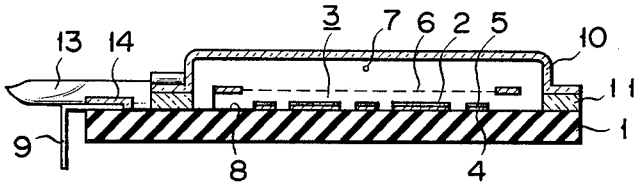
FIG. 4 is a cross-sectional side view as taken along line IV—IV in FIG. 3.

With the modified display tube shown in FIGS. 3 and 4, each electroconductive layer 8 to which a corresponding anode 4, grid 6 or cathode 7 is connected extends, unlike the first-mentioned embodiment, on that portion of a substrate 1 which is beyond a cover glass 10. That end of the electroconductive layer which is beyond the cover glass 10 is electrically connected to a corresponding lead-in strip 9. The lead-in strip is mounted at a place where it is connected to the electroconductive layer 8. The mounting of the lead-in strip is effected by thermally fusing a first glass onto the substrate 1 with the lead-in strip sandwiched between ths substrate 1 and the frit glass. Like the first-mentioned embodiment, the lead-in strip 9 extends out in the same direction as an exhaust tube 13 and it is bent partway in a position short of a sealed free end of the exhaust tube and extends downward.

The display tube as applied to a display section of a desk-top type electronic calculator 16 will now be explained below by referring to FIGS. 5 and 6.

Figure 5:
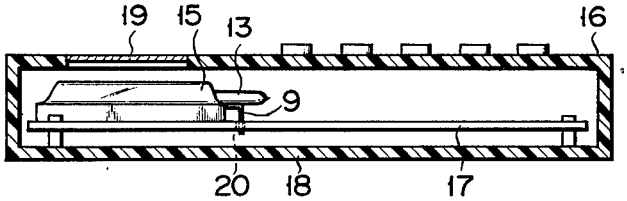
FIG. 5 is a cross-sectional side view showing a desk-top type electronic calculator in which the flat type display tube according to this invention is incorporated.

In FIG. 5 the flat-type display tube 15 is arranged substantially in a parallel relation to the bottom surface of the desk-top type electronic calculator. The display tube 15 is mounted on a printed board 17 within the desk-top calculator 16. Where the lead-in strip 9 and exhaust tube 13 extend in the same direction as shown in FIG. 5, a casing 18 of the calculator 16 can be made more compact. That is, the casing 18 can be designed with no consideration pair to any extra space in which the exhaust tube extends. Since the lead-in strip 9 is bent downward with respect to the plane of the surface of the substrate, it can be easily connected to the corresponding terminal of the printed board 17. Particularly where an electrical connection is made by providing a bore 20 in the printed board and inserting the lead-in strip 9 into the bore for soldering, the desk-top calculator can be assembled with good efficiency.

Figure 6:
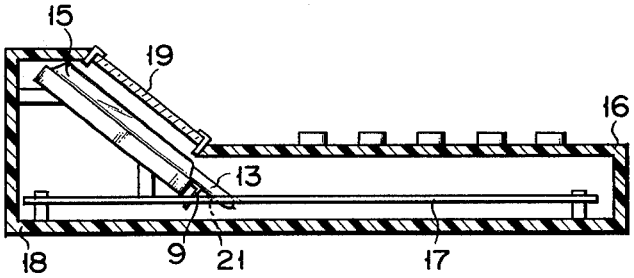
FIG. 6 is a cross-sectional side view showing another desk-top type electronic calculator in which the flat type display tube according to this invention is incorporated.

As shown in FIG. 6, the display tube 15 can be mounted at a certain angle to the bottom surface of the desk-top type electronic calculator. In this case, a hole 21 is provided in a printed board 17 so that the sealed free end of the exhaust tube 13 can be inserted into the hole 21 in the printed board 17. The arrangement permits the casing of the calculator to be made more compact. Furthermore, the display tube can be easily positioned within the casing and the calculator can be assembled with high efficiency.

The use of the compactly designed display tube offers the advantage of making the desk-top type electronic calculator more compact. This outstanding advantage is attained by the fact that the lead-in strip 9 and exhaust tube extend substantially in the same direction from that side wall of the cover glass 10. Furthermore, the lead-in strip 9 is bent partway in the position short of the sealed free end of the tube, thus providing no inconvenience during the manufacture of the display tube.

Although in the above-mentioned embodiment the strip-like conductor 9 is used as a lead-in conductor, this invention should not be restricted thereto. It may be replaced by a bar-, wire- or column-like conductor. It is not necessary that all the lead-in strips 9 be bent as shown in the abovementioned embodiment. It is possible, for example, to bend only these strips situated in the neighborhood of the exhaust tube 13 as will be understood from the subject matter of this invention. It is not required that the lead-in strip 9 be bent substantially vertical to the surface of the substrate. The direction in which the lead-in strip 9 is bent can be suitably determined according to the design of the desk-top type electronic calculator in which the display tube is used. Although in the above-mentioned embodiment use is made of a multi-digit type display tube having a plurality of fluorescent lamp display sections, this invention should not be limited thereto. It will be apparent that one-digit type display tube may be used.

What is claimed is:

1. A flat-type display tube comprising an insulating substrate, a fluorescent display section consisting of a plurality of anode segments arranged in a predetermined pattern on the insulating substrate, a cathode disposed in a spaced apart relation to the display section, a box-like cover means hermetically sealed to the substrate in a manner to enclose the display section and the cathode, an exhaust tube mounted at the side wall of the cover means to communicate at one end with the interior of the cover means and extending outward in a manner to have the other end sealed, and a plurality of connecting means extending outward in the same direction of the exhaust tube and at least one or two of which are bent downward partway in a position short of the sealed free end of the exhaust tube, said connecting means having one end electrically connected to an external drive circuit and the other end electrically connected within the cover means to the display unit and cathode.

2. The flat-type display tube according to claim 1, in which said plurality of connecting means consist of a plurality of electroconductive layers formed on the substrate and electrically connected to said display section and cathode, and a plurality of lead-in conductors electrically connected to the corresponding electroconductive layers and electrically connected outside the display tube to the external drive circuit.

3. The flat-type display tube according to claim 2, in which said electroconductive layers and lead-in conductors are electrically connected on the substrate and within the cover means, and said lead-in conductors are hermetically sealed between said cover means and said substrate.

4. The flat-type display tube according to claim 2, in which said electroconductive layers and lead-in conductors are electrically interconnected on that surface of the substrate which is situated outside of the cover means and said lead-in conductor is fitted on the substrate.

5. The flat-type display tube according to claim 1, in which said exhaust tube extends in a direction parallel to the surface of the substrate and said connecting means are bent partway in a direction substantially vertical to the plane of the surface of the substrate.

6. A flat-type multi-digit display tube comprising an insulating substrate, a plurality of fluorescent display sections each consisting of a plurality of anode segments arranged in a predetermined pattern on the substrate, a cathode disposed in a spaced apart relation to the display sections, a box-like cover means hermetically sealed to the substrate in a manner to enclose the display section, an exhaust tube mounted at the side wall of the cover means to communicate at one end with the interior of the cover means and extending outward in a manner to have the other end sealed, and a plurality of connecting means extending outward in the same direction as the exhaust tube and at least one or two of which are bent partway in a position short of the sealed free end of the exhaust tube, said connecting means having one end electrically connected to an external drive circuit and the other end electrically connected within the cover means to the display unit and cathode.

7. The flat-type multi-digit display tube according to claim 6, in which said plurality of connecting means consist of a plurality of electroconductive layers formed on the substrate and electrically connected to said display sections and cathode, and a plurality of lead-in conductors electrically connected to the corresponding electroconductive layers and electrically connected outside the display tube to the external drive circuit.

8. The flat-type multi-digit display tube according to claim 7, in which said electroconductive layers and lead-in conductors are electrically connected on the substrate and within the cover means, and said lead-in conductors are hermetically sealed between said cover means and said substrate.

9. The flat-type multi-digit display tube according to claim 7, in which said electroconductive layers and lead-in conductors are electrically interconnected on that surface of the substrate which is situated outside of the cover means and said lead-in conductor is fitted on the substrate.

10. The flat-type multi-digit display tube according to claim 6, in which said exhaust tube extends in a direction parallel to the surface of the substrate and said connecting means are bent partway in a direction substantially to the plane of the surface of the substrate.

* * * * *